US011682837B2

(12) United States Patent
Wang et al.

(10) Patent No.: US 11,682,837 B2
(45) Date of Patent: Jun. 20, 2023

(54) ANTENNA MODULE AND ELECTRONIC DEVICE

(71) Applicant: PEGATRON CORPORATION, Taipei (TW)

(72) Inventors: I Wen Wang, Taipei (TW); Ming Hong Lee, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 29 days.

(21) Appl. No.: 17/565,160

(22) Filed: Dec. 29, 2021

(65) Prior Publication Data

US 2022/0247078 A1 Aug. 4, 2022

(30) Foreign Application Priority Data

Feb. 4, 2021 (TW) ..... 110104180

(51) Int. Cl.

| | |
|---|---|
| ***H01Q 5/378*** | (2015.01) |
| ***H01Q 5/335*** | (2015.01) |
| ***H01Q 5/371*** | (2015.01) |
| ***H01Q 1/02*** | (2006.01) |
| ***H01Q 1/24*** | (2006.01) |
| *H01Q 1/48* | (2006.01) |

(52) U.S. Cl.

CPC ..... *H01Q 5/378* (2015.01); *H01Q 1/02* (2013.01); *H01Q 1/243* (2013.01); *H01Q 5/335* (2015.01); *H01Q 5/371* (2015.01); *H01Q 1/48* (2013.01)

(58) Field of Classification Search

CPC ..... H01Q 5/378; H01Q 5/335; H01Q 5/371; H01Q 1/02; H01Q 1/243; H01Q 1/48

See application file for complete search history.

(56) References Cited

U.S. PATENT DOCUMENTS

| | | | | |
|---|---|---|---|---|
| 2012/0105292 | A1 | 5/2012 | Wong et al. | |
| 2012/0223867 | A1 | 9/2012 | Morton et al. | |
| 2016/0064832 | A1 | 3/2016 | Shin et al. | |
| 2018/0026326 | A1* | 1/2018 | Noh | H01Q 1/52 343/904 |
| 2019/0123423 | A1* | 4/2019 | Wu | H01Q 1/243 |

FOREIGN PATENT DOCUMENTS

| | | |
|---|---|---|
| TW | 383193 | 6/2010 |

OTHER PUBLICATIONS

"Search Report of Europe Counterpart Application", dated Jun. 7, 2022, pp. 1-11.

* cited by examiner

*Primary Examiner* — Andrea Lindgren Baltzell

(74) *Attorney, Agent, or Firm* — J.C. Patents

(57) ABSTRACT

An antenna module, including a feed point, a ground plane, a main radiator, and a parasitic radiator, is provided. The main radiator includes a first portion, a second portion, and a third portion. The first portion and the second portion extend from the feed point and meet at an intersection after turning. The third portion has a first section and a second section. The first section of the third portion is connected to the intersection, and the second section is connected to the ground plane. The parasitic radiator is connected to the second section and extends towards the first section of the third portion and keeps a coupling gap away from the first section.

17 Claims, 10 Drawing Sheets

ANTENNA MODULE AND ELECTRONIC DEVICE

CROSS-REFERENCE TO RELATED APPLICATION

This application claims the priority benefit of Taiwan application serial no. 110104180, filed on Feb. 4, 2021. The entirety of the above-mentioned patent application is hereby incorporated by reference herein and made a part of this specification.

BACKGROUND

Technology Field

The invention relates to an antenna module and an electronic device using the antenna module, and particularly relates to a multi-band and wideband antenna module and an electronic device using the antenna module.

Description of Related Art

Among the current Netcom products, an LTE frequency band (a low frequency: 704-960 MHz and a high frequency: 1710-2690 MHz) of a fourth-generation communication system is commonly used at present. In response to the advent of a fifth-generation communication system, a bandwidth required by LTE has increased significantly, where the low frequency is 617-960 MHz, which has an increase of nearly 100 MHz, while an intermediate frequency is 1428-2690 MHz, and the high frequency is 3300 MHz-4990 MHz, and a bandwidth of the intermediate-high frequency is increased by about 2000 MHz. The original fourth-generation LTE framework cannot meet the demand for the bandwidth.

SUMMARY

The invention is directed to an antenna module with multi-band and wideband functions.

The invention is directed to an electronic device using the above antenna module.

The invention provides an antenna module including a feed point, a ground plane, a main radiator and a parasitic radiator. The main radiator includes a first portion, a second portion, and a third portion, where the first portion and the second portion extend from the feed point and meet at an intersection after turning. The third portion at least includes a first section and a second section, the first section of the third portion is connected to the intersection, and the second section is connected to the ground plane. The parasitic radiator is connected to the second section and extends towards the first section of the third portion and keeps a coupling gap away from the first section. A feed signal is configured to branch to go along the first portion and the second portion from the feed point and then merge at the intersection, and then sequentially go along the third portion and the ground plane to excite at a first frequency band and a second frequency band. The feed signal is configured to branch to go along the first portion and the second portion from the feed point and then merge at the intersection, and then sequentially go along a part of the first section of the third portion, the coupling gap, the parasitic radiator, the second section of the third portion, and the ground plane to excite at a third frequency band.

In an embodiment of the invention, the antenna module further includes an extended radiator extending from the third portion to adjust impedance matching of the first frequency band.

In an embodiment of the invention, a length of the first portion is greater than a length of the second portion, and the maximum width of the first portion is less than the maximum width of the second portion.

In an embodiment of the invention, the ground plane includes a first ground portion and a second ground portion separated from each other. The first ground portion is close to the second portion, the second ground portion is connected to the third portion, and the first ground portion and the second ground portion are connected to a system ground plane.

In an embodiment of the invention, the coupling gap is located between the parasitic radiator and the first section of the third portion.

In an embodiment of the invention, a length of the feed signal respectively passing through the first portion and the second portion from the feed point and then meeting at the intersection, and then sequentially passing through the third portion and the ground plane is equivalent to a wavelength of the first frequency band and 1.5 times a wavelength of the second frequency band.

In an embodiment of the invention, a length of the feed signal respectively passing through the first portion and the second portion from the feed point and then meeting at the intersection, and then sequentially passing through a part of the first section of the third portion, the coupling gap, the parasitic radiator, the second section of the third portion, and the ground plane is equivalent to a wavelength of the third frequency band.

In an embodiment of the invention, the first frequency band is between 617 MHz and 960 MHz, the second frequency band is between 1428 MHz and 2690 MHz, and the third frequency band is between 3300 MHz and 4990 MHz.

The invention provides an electronic device including a heat dissipation conductor, an insulating housing and the antenna module. The insulating housing covers at least part of the heat dissipation conductor. The antenna module is disposed on the insulating housing, where the insulating housing is located between the main radiator of the antenna module and the heat dissipation conductor, and the ground plane of the antenna module is connected to the heat dissipation conductor.

In an embodiment of the invention, a distance between the main radiator and the heat dissipation conductor is between 2 mm and 20 mm.

Based on the above description, the first portion and the second portion of the main radiator of the antenna module of the invention extend from the feed point and meet at an intersection far away from the feed point, the first section of the third portion is connected to the intersection, and the second portion of the third portion is connected to the ground plane. The parasitic radiator is connected to the second section and extends toward the first section of the third portion and keeps a coupling gap away from the first section. Based on the above design, the feed signal may go along the first portion and the second portion from the feed point and then meet at the intersection, and then sequentially go along the third portion and the ground plane to excite at the first frequency band and the second frequency band. In addition, the feed signal may go along the first portion and the second portion from the feed point and then meet at the intersection, and then sequentially go along a part of the first section of the third portion, the coupling gap, the parasitic radiator, the second section of the third portion, and the ground plane to excite at the third frequency band. Therefore, the antenna module of the invention may have multi-band and wideband effects.

In addition, in the electronic device of the invention, the antenna module is arranged on the insulating housing, and the ground plane of the antenna module is connected to the heat dissipation conductor, so that the heat dissipation conductor serves as the system ground plane. In this way, besides that a ground area is increased, even if the antenna module is quite close to the heat dissipation conductor, the efficiency of the antenna module is not affected, which achieves reduction of an antenna clearance area.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
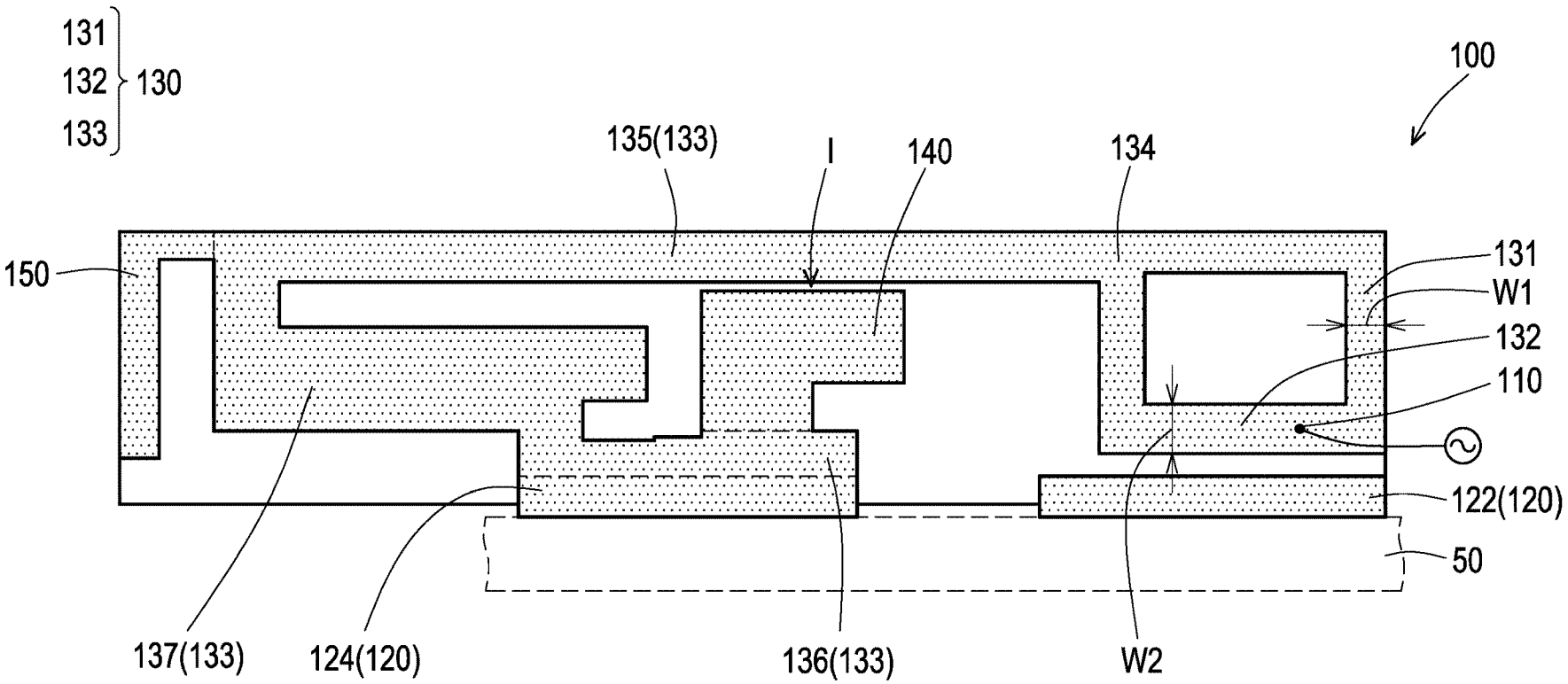
FIG. 1A is a schematic diagram of an antenna module according to an embodiment of the invention.

FIG. 1A is a schematic diagram of an antenna module according to an embodiment of the invention. Referring to FIG. 1A, the antenna module 100 of the embodiment may excite at a first frequency band, a second frequency band, and a third frequency band. The first frequency band is between 617 MHz and 960 MHz, the second frequency band is between 1428 MHz and 2690 MHz, and the third frequency band is between 3300 MHz and 4990 MHz. Certainly, the ranges of the first frequency band, the second frequency band, and the third frequency band are not limited thereto. The antenna module 100 of the embodiment my meet a full frequency band of Sub-6 GHz of LTE. The antenna module 100 is described in detail below.

The antenna module 100 of the embodiment may be in the form of a loop antenna. The antenna module 100 includes a feed point 110, a ground plane 120, a main radiator 130 and a parasitic radiator 140. The main radiator 130 includes a first portion 131, a second portion 132 and a third portion 133. The first portion 131 and the second portion 132 of the main radiator 130 extend in different directions from the feed point 110 and meet at an intersection 134 after turning. In the embodiment, the first portion 131 and the second portion 132 of the main radiator 130 form a closed loop, such as a rectangle, but a shape of the closed ring is not limited thereto.

A length of the first portion 131 (the length of a path from the feed point 110 to the right to the intersection 134) of the main radiator 130 is greater than a length of the second portion 132 (the length of a path from the feed point 110 to the left to the intersection 134). In addition, the maximum width W1 of the first portion 131 is less than the maximum width W2 of the second portion 132.

In the embodiment, a feed signal may travel from the feed point 110 along two paths, the first portion 131 and the second portion 132 of the main radiator 130 until meeting at the intersection. Therefore, the first portion 131 and the second portion 132 of the main radiator 130 may be used to provide two signal paths, so that the first frequency band may achieve a dual-mode effect.

The third portion 133 includes a first section 135, a second section 136, and a third section 137 connected to the first section 135 and the second section 136. In the embodiment, the first section 135, the third section 137, and the second section 136 are connected to each other in a bending manner, and present a pattern close to a U-shape. The first section 135 of the third portion 133 is connected to the intersection 134, and the second section 136 is connected to the ground plane 120.

The parasitic radiator 140 is connected to the second section 136 and extends toward the first section 135. In the embodiment, a coupling gap I is kept between the parasitic radiator 140 and the first section 135 of the third portion 133.

In addition, the ground plane 120 includes a first ground portion 122 and a second ground portion 124 separated from each other. The first ground portion 122 is close to the second portion 132 of the main radiator 130, and the second ground portion 124 is connected to the third portion 133 of the main radiator 130. The first ground portion 122 and the second ground portion 124 are connected to a system ground plane 50.

Moreover, the antenna module 100 further includes an extended radiator 150 that extends from the first section 135 of the third portion 133 of the main radiator 130 to perform impedance matching of the first frequency band to achieve a wideband of 617 MHz-960 MHz.

Figure 1B:
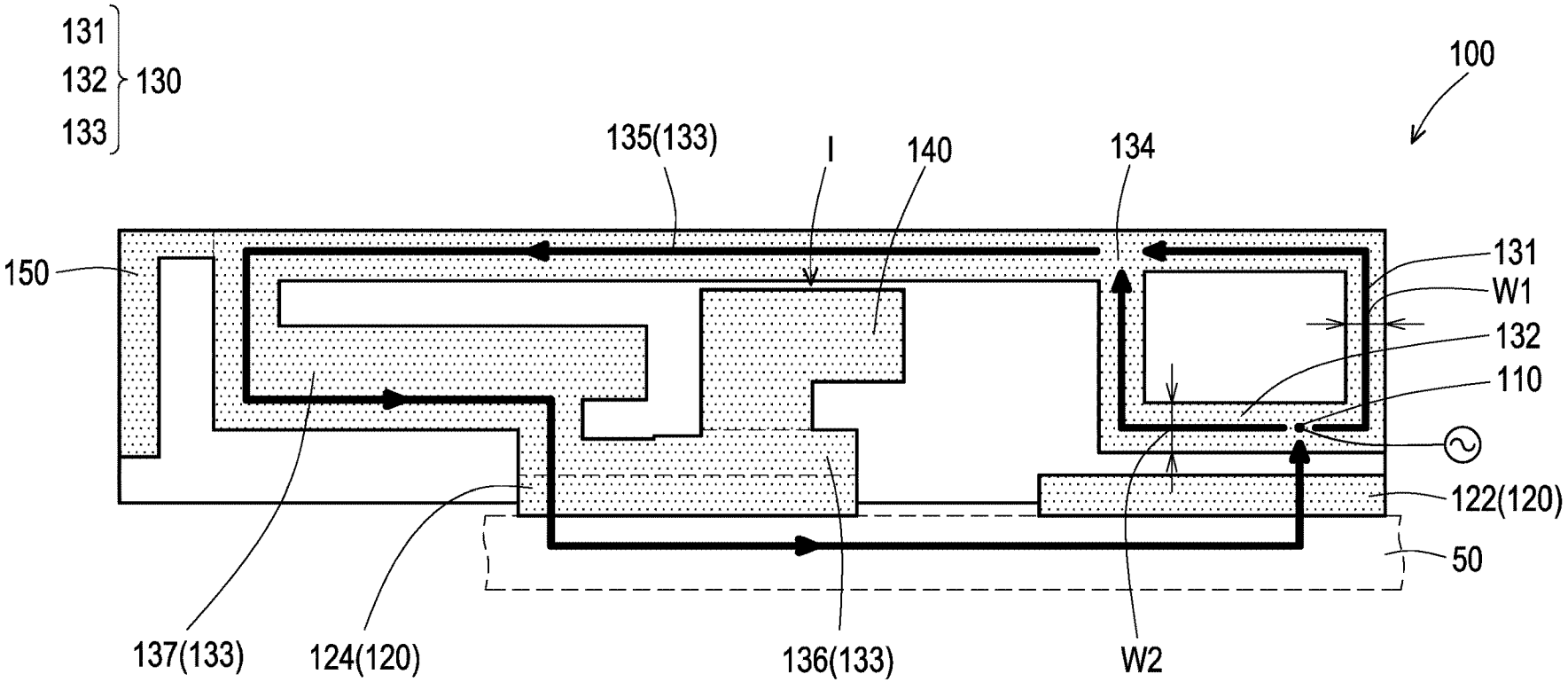
FIG. 1B is a schematic diagram of a signal path of the antenna module of FIG. 1A exciting at the first frequency band and the second frequency band.

FIG. 1B is a schematic diagram of a signal path of the antenna module of FIG. 1A exciting at the first frequency band and the second frequency band. Referring to bold lines in FIG. 1B, the feed signal may go along the first portion 131 and the second portion 132 from the feed point 110 and then meet at the intersection 134, and then sequentially go along the third portion 133, the second ground portion 124 of the ground plane 120, the system ground plane 50 and the first ground portion 122 of the ground plane 120 to form a larger loop excitation path.

In the embodiment, the above path may excite at a first frequency band and a second frequency band. The second frequency band is a frequency multiplication of the first frequency band. Therefore, the length of the feed signal going along the first portion 131 and the second portion 132 from the feed point 110 and then meeting at the intersection 134, and then sequentially going along the third portion 133 and the ground plane 120 is equivalent to a wavelength of the first frequency band and 1.5 times a wavelength of the second frequency band.

Figure 1C:
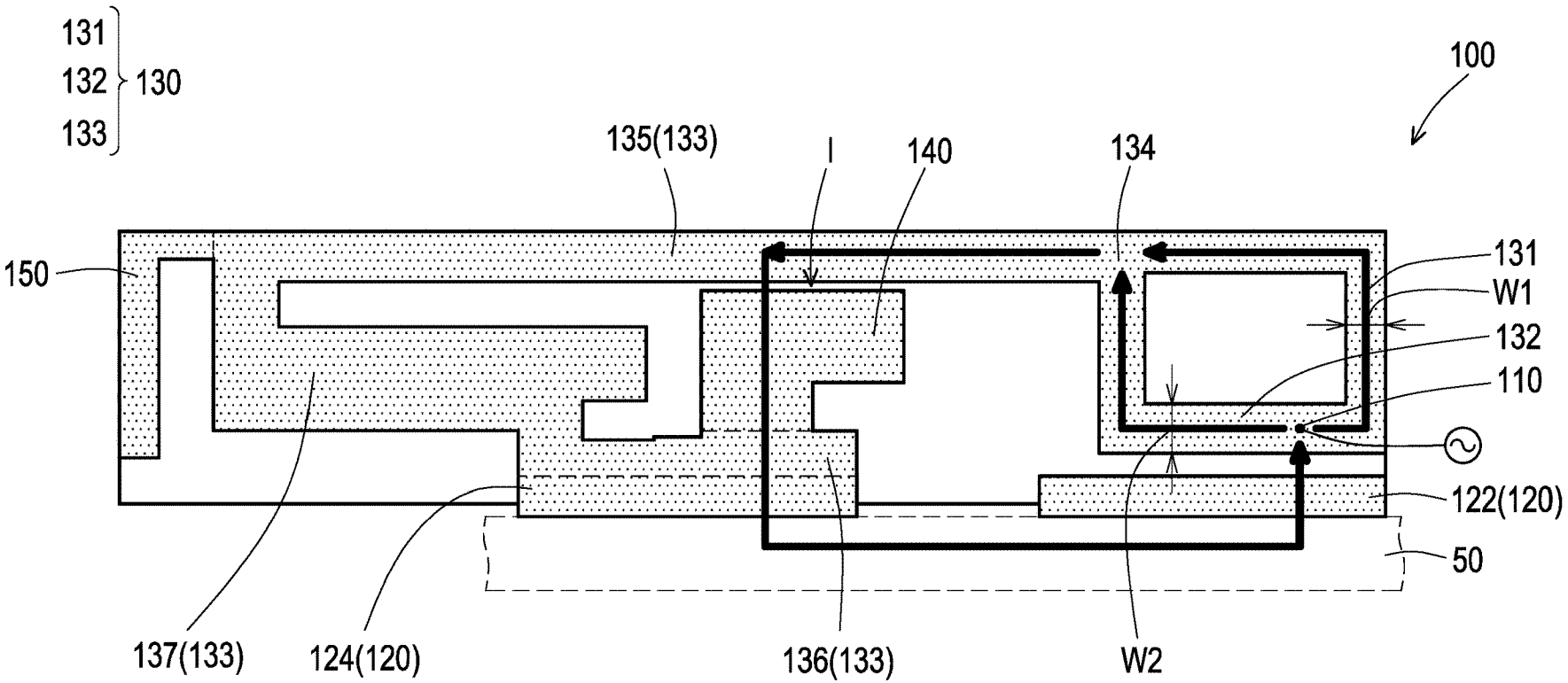
FIG. 1C is a schematic diagram of a signal path of the antenna module of FIG. 1A exciting at a third frequency band.

FIG. 1C is a schematic diagram of a signal path of the antenna module of FIG. 1A exciting at the third frequency band. Referring to the bold lines in FIG. 1C, the feed signal may also go along the first portion 131 and the second portion 132 from the feed point 110 and then meet at the intersection 134, and then sequentially go along a part of the first section 135 of the third portion 133, the coupling gap I, the parasitic radiator 140, the second section 136 of the third portion 133, the second ground portion 124 of the ground plane 120, the system ground plane 50, and the first ground portion 122 of the ground plane 120 to form a smaller loop excitation path.

In the embodiment, the above path can excite at a third frequency band. A length of the feed signal going along the first portion 131 and the second portion 132 from the feed point 110 and then meeting at the intersection 134, and then sequentially going along a part of the first section 135 of the third portion 133, the coupling gap I, the parasitic radiator 140, the second section 136 of the third portion 133, and the ground plane 50 is equivalent to a wavelength of the third frequency band.

Therefore, the antenna module 100 of the embodiment extends from the feed point 110 via the first portion 131 and the second portion 132 of the main radiator 130 and has the intersection 134 far away from the feed point 110. The first section 135 of the third portion 133 is connected to the intersection 134, and the second section 136 of the third portion 133 is connected to the ground plane 120. The parasitic radiator 140 is connected to the second section 136 and extends toward the first section 135, and may meet a full frequency band of Sub-6 GHz of LTE (three bandwidths of a low frequency 617 MHz-960 MHz, an intermediate frequency 1428 MHz-2690 MHz, and a high frequency 3300 MHz-4990 MHz).

In the contrast, the conventional antenna cannot achieve such wideband, it needs a switch to switch the frequency bands, or it needs to design an antenna that may resonate at different frequency bands according to regulations of different nations, or it needs to use LC components to adjust impedance matching of the antenna to achieve such a wideband. Since the antenna module 100 of the embodiment may reach the full frequency band of Sub-6 GHz of LTE, there is no need to arrange additional components to perform switching, and there is no need to use different antennas by nations, which is very convenient in manufacturing.

Figure 2:
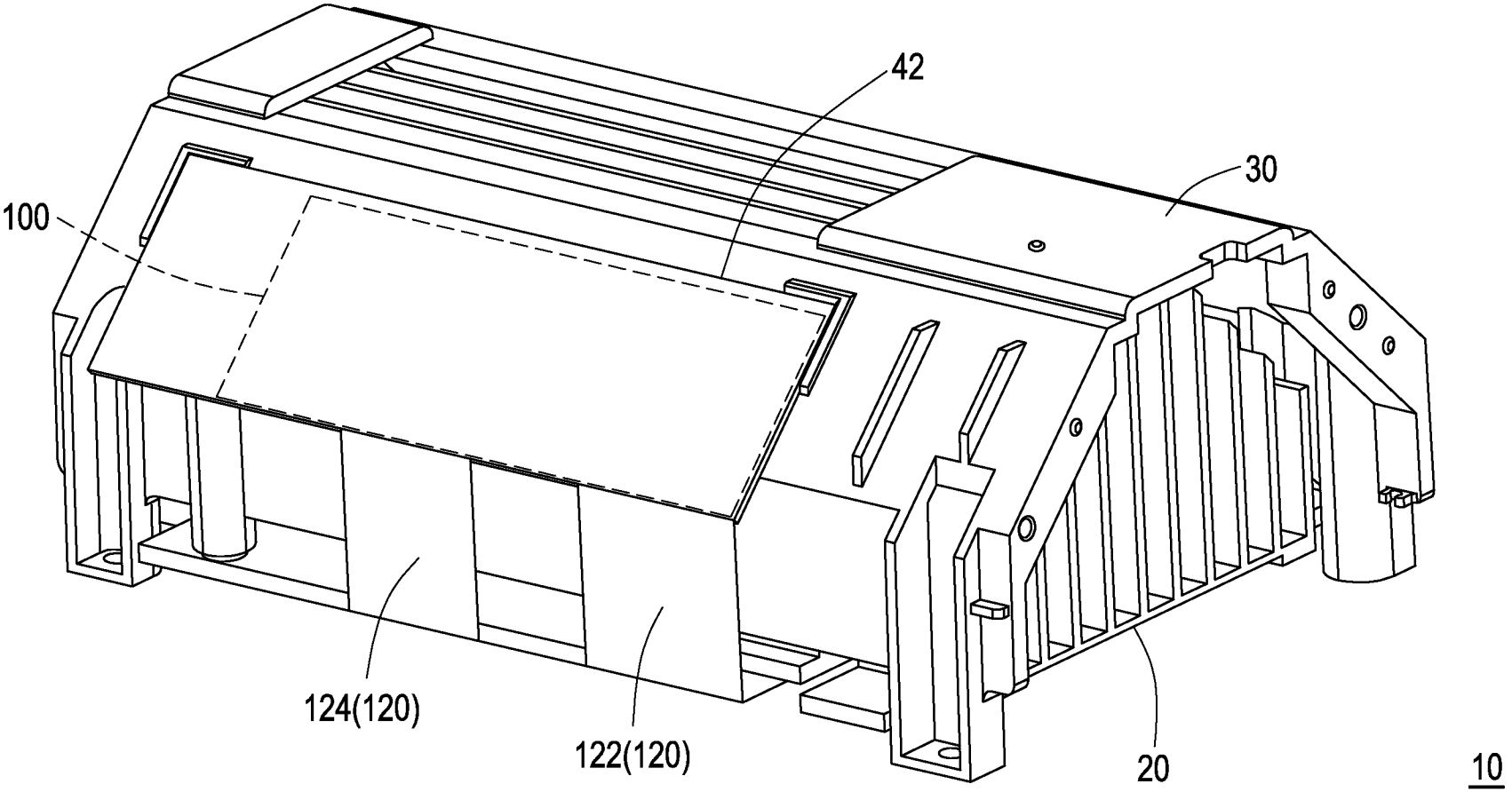
FIG. 2 is a schematic diagram of an electronic device according to an embodiment of the invention.

FIG. 2 is a schematic diagram of an electronic device according to an embodiment of the invention. Referring to FIG. 2, in the embodiment, the electronic device 10 is, for example, a wireless router, but the type of the electronic device 10 is not limited thereto. The electronic device 10 includes a heat dissipation conductor 20, an insulating housing 30 and the antenna module 100. The heat dissipation conductor 20 is, for example, metal heat dissipation fins, and the insulating housing 30 is, for example, a plastic shell. The insulating housing 30 covers at least part of the heat dissipation conductor 20. The antenna module 100 is disposed on a circuit board 42, and the circuit board 42 is disposed on the insulating housing 30. The ground plane 120 of the antenna module 100 is connected to the heat dissipation conductor 20.

In the embodiment, the heat dissipation conductor 20 is the system ground plane 50 (indicated in FIG. 1A). In the contrast, the conventional antenna requires a sufficient distance from the nearby metal to obtain a sufficient antenna clearance area, so as to prevent the nearby metal from affecting the antenna efficiency, in the embodiment, since the ground plane 120 of the antenna module 100 is connected to the heat dissipation conductor 20, the heat dissipation conductor 20 of the electronic device 10 may be used as the system ground plane 50 of the antenna. Therefore, the heat dissipation conductor 20 does not affect the antenna efficiency of the antenna module 100, and the distance between the antenna module 100 and the heat dissipation conductor 20 may be reduced. A distance between the main radiator 130 (indicated in FIG. 1A) of the antenna module 100 and the heat dissipation conductor 20 may be, for example, between 2 mm and 20 mm, or even between 2 mm and 10 mm, which may reduce an overall volume of the electronic device 10.

Figure 3:
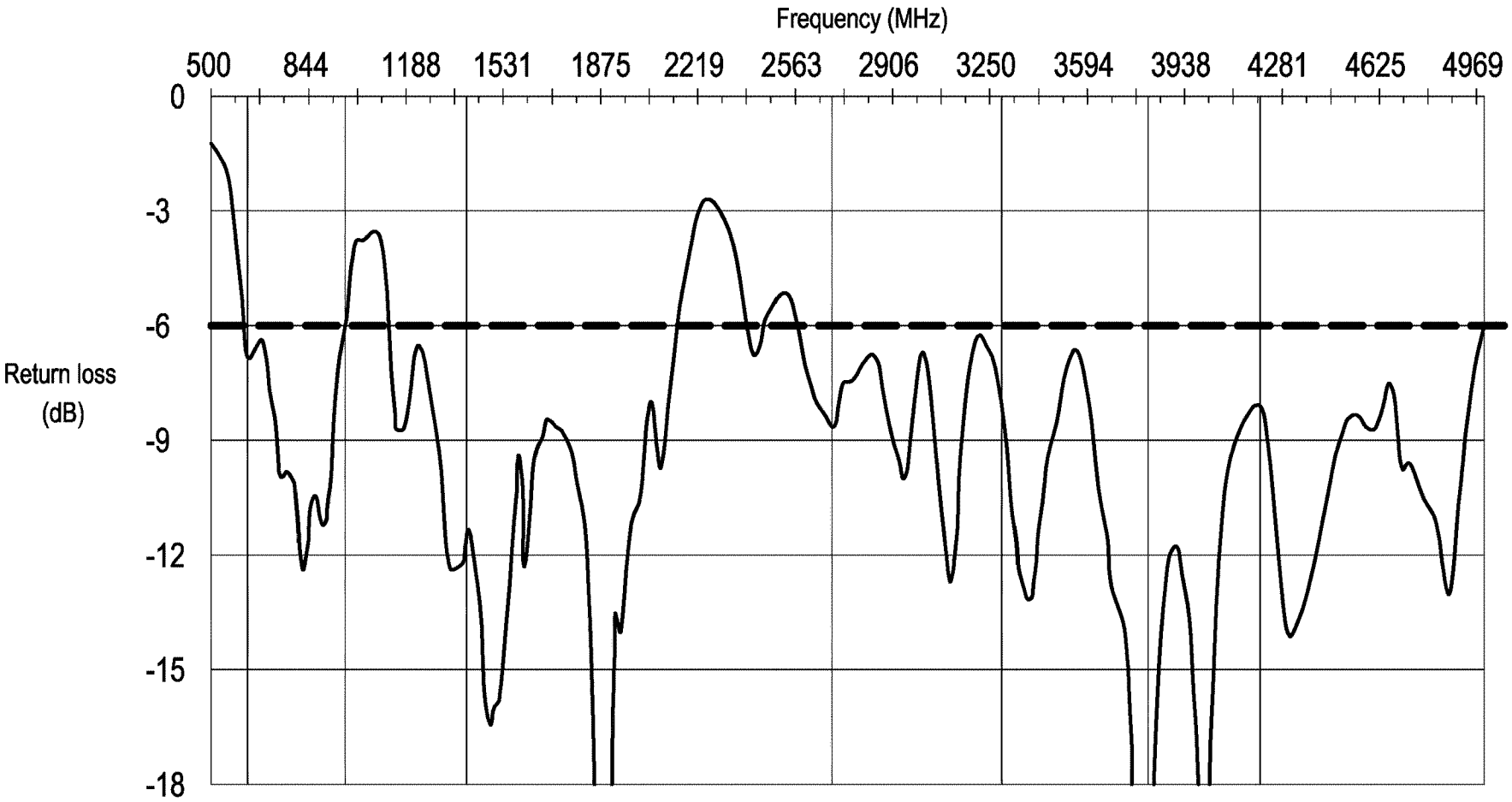
FIG. 3 is a plot of frequency vs. return loss of the antenna module of FIG. 1A.

FIG. 3 is a plot of frequency vs. return loss of the antenna module of FIG. 1A. Referring to FIG. 3, the return losses of the antenna module 100 in the first frequency band, the second frequency band, and the third frequency band may all be lower than −6 dB, which achieves a good performance. In addition, through simulation, in the embodiment, the antenna efficiency of the antenna module 100 in the first frequency band is between 33% and 51%, the antenna efficiency in the second frequency band is between 39% and 46%, and the antenna efficiency in the third frequency band is between 46% and 57%, which achieves a good performance.

Figure 4B:
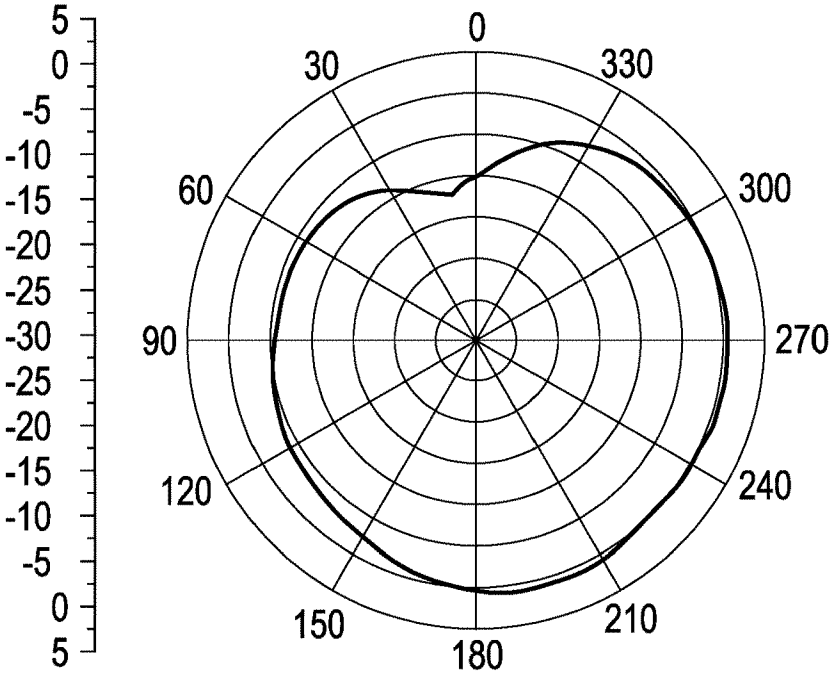
FIG. 4A to FIG. 4C are antenna pattern diagrams of the antenna module of FIG. 1A in an XZ plane, a YZ plane, and an XY plane when the antenna module is in a first frequency band.
Figure 4A:
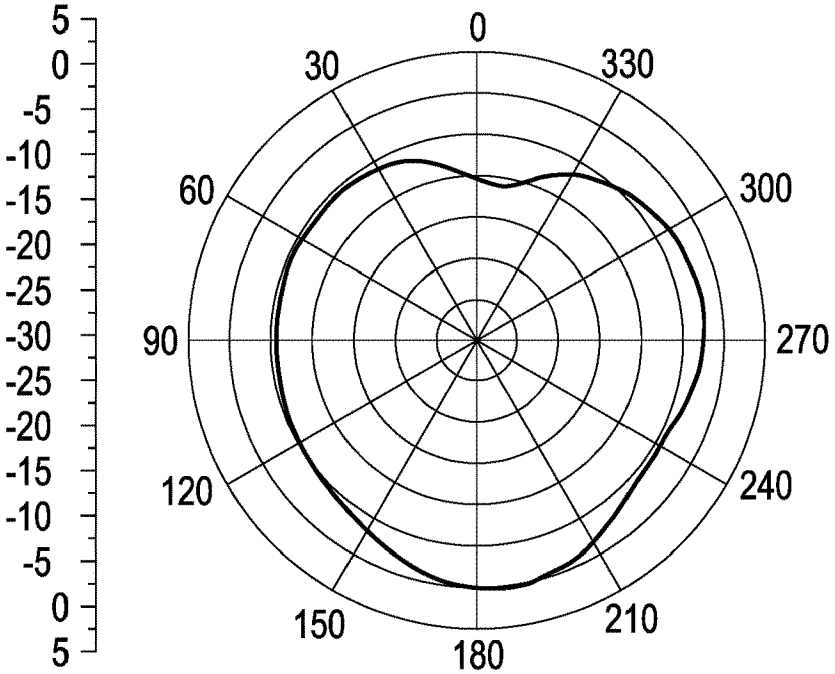
Figure 5A:
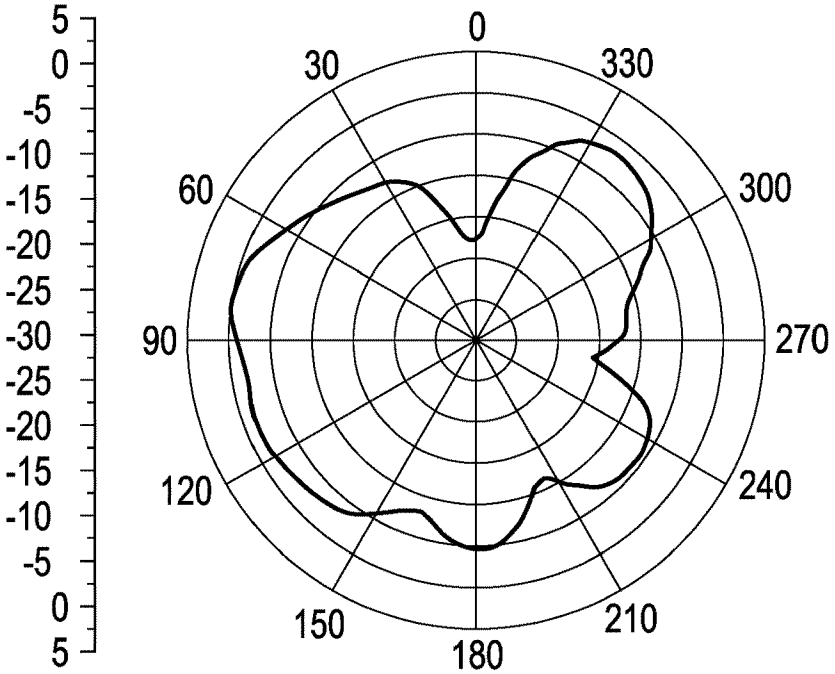
FIG. 5A to FIG. 5C are antenna pattern diagrams of the antenna module of FIG. 1A in the XZ plane, the YZ plane, and the XY plane when the antenna module is in a second frequency band.
Figure 4C:
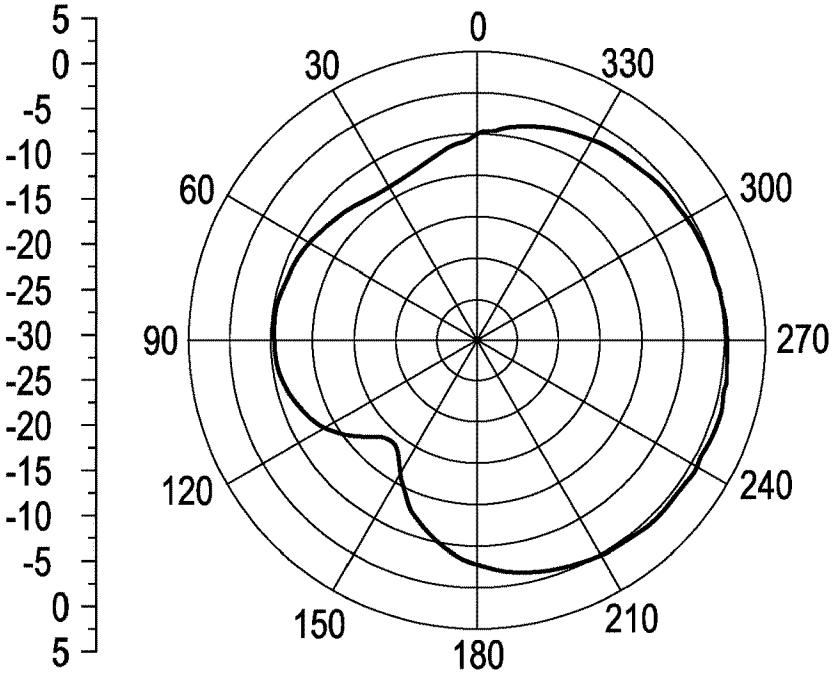
Figure 5C:
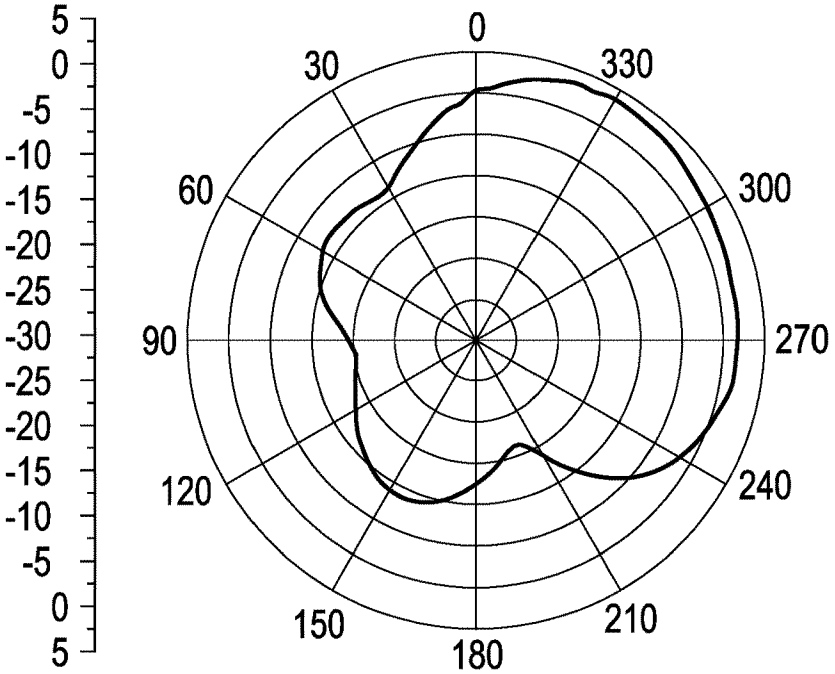
Figure 5B:
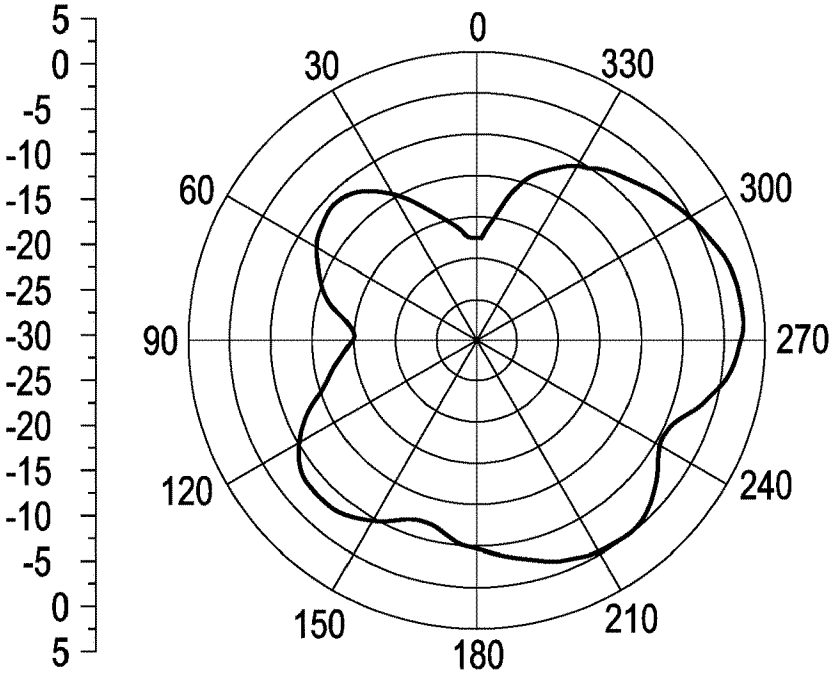
Figure 6B:
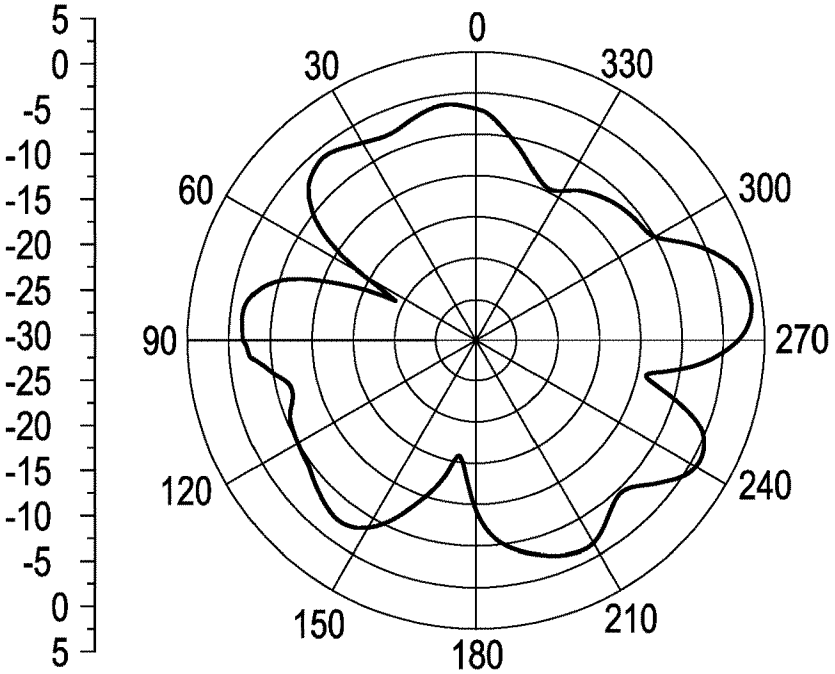
FIG. 6A to FIG. 6C are antenna pattern diagrams of the antenna module of FIG. 1A in the XZ plane, the YZ plane and the XY plane when the antenna module is in a third frequency band.
Figure 6A:
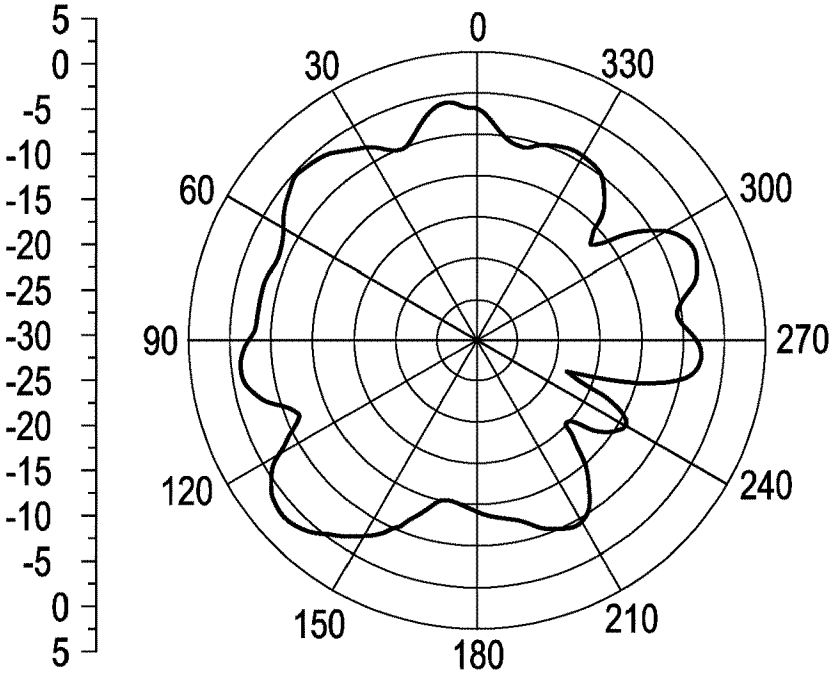
Figure 6C:
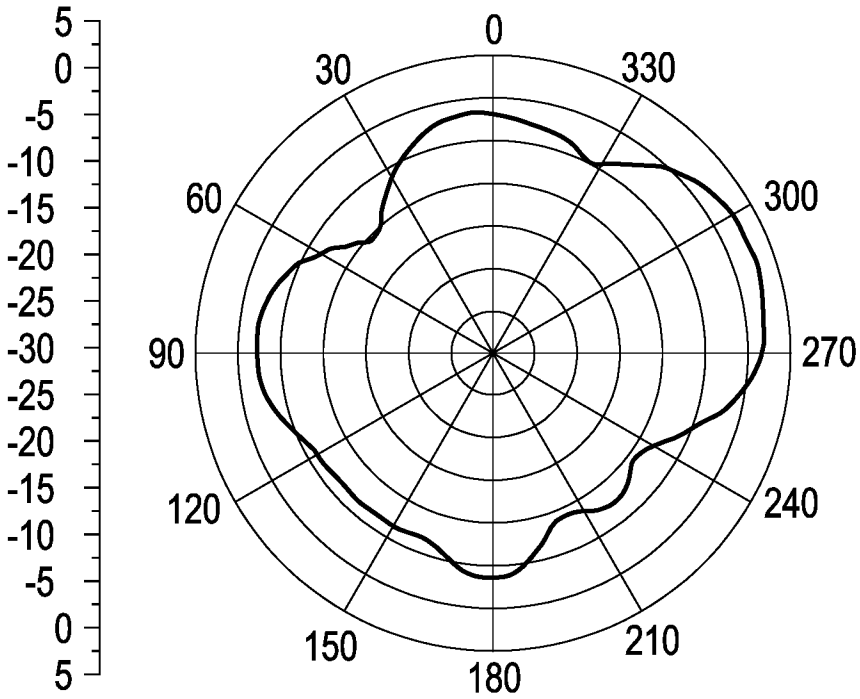

FIG. 4A to FIG. 4C are antenna pattern diagrams of the antenna module of FIG. 1A in an XZ plane, a YZ plane, and an XY plane when the antenna module is in the first frequency band. FIG. 5A to FIG. 5C are antenna pattern diagrams of the antenna module of FIG. 1A in the XZ plane, the YZ plane, and the XY plane when the antenna module is in the second frequency band. FIG. 6A to FIG. 6C are antenna pattern diagrams of the antenna module of FIG. 1A in the XZ plane, the YZ plane and the XY plane when the antenna module is in the third frequency band.

It should be noted that 777 MHz is taken as an example in FIG. 4A to FIG. 4C, 1995 MHz is taken as an example in FIG. 5A to FIG. 5C, and 3800 MHz is taken as an example in FIG. 6A to FIG. 6C. Referring to FIG. 4A to FIG. 4C, 5A to FIG. 5C, and FIG. 6A to FIG. 6C, the antenna module 100 of the embodiment has good performance in all of the XZ plane, YZ plane, and XY plane in the first frequency band, the second frequency band, and the third frequency band.

In summary, the first portion and the second portion of the main radiator of the antenna module of the invention extend from the feed point and meet at an intersection far away from the feed point, the first section of the third portion is connected to the intersection, and the second portion of the third portion is connected to the ground plane. The parasitic radiator is connected to the second section and extends toward the first section of the third portion. Based on the above design, the feed signal may go along the first portion and the second portion from the feed point and then meet at the intersection, and then sequentially go along the third portion and the ground plane to excite the first frequency band and the second frequency band. In addition, the feed signal may go along the first portion and the second portion from the feed point and then meet at the intersection, and then sequentially go along a part of the first section of the third portion, the coupling gap, the parasitic radiator, the second section of the third portion, and the ground plane to excite the third frequency band. Therefore, the antenna module of the invention may have multi-band and wideband effects.

In addition, in the electronic device of the invention, the antenna module is disposed on the insulating housing, and the ground plane of the antenna module is connected to the heat dissipation conductor, so that the heat dissipation conductor serves as the system ground plane.

In this way, besides that a ground area is increased, even if the antenna module is quite close to the heat dissipation conductor, the efficiency of the antenna module is not affected, which achieves an effect of reducing an antenna clearance area.

What is claimed is:

1. An antenna module, comprising:

a feed point;

a ground plane;

a main radiator, comprising a first portion, a second portion, and a third portion, wherein the first portion and the second portion extend from the feed point and meet at an intersection, the third portion at least comprises a first section and a second section, the first section of the third portion is connected to the intersection, and the second section is connected to the ground plane; and a parasitic radiator, connected to the second section and extending towards the first section of the third portion and having a coupling gap away from the first section, wherein a feed signal is configured to branch at the feed point and go through the first portion and the second portion and then merge at the intersection, and then sequentially go along the third portion and the ground plane to excite at a first frequency band and a second frequency band, and go along a part of the first section of the third portion, the coupling gap, the parasitic radiator, the second section of the third portion, and the ground plane to excite at a third frequency band.

2. The antenna module as claimed in claim 1, further comprising an extended radiator extending from the third portion to adjust impedance matching of the first frequency band.

3. The antenna module as claimed in claim 1, wherein a length of the first portion is greater than a length of the second portion, and a maximum width of the first portion is less than a maximum width of the second portion.

4. The antenna module as claimed in claim 1, wherein the ground plane comprises a first ground portion and a second ground portion separated from each other, the first ground portion is close to the second portion, the second ground portion is connected to the third portion, and the first ground portion and the second ground portion are connected to a system ground plane.

5. The antenna module as claimed in claim 1, wherein the coupling gap is located between the parasitic radiator and the first section of the third portion.

6. The antenna module as claimed in claim 1, wherein a length of the feed signal going along the first portion and the second portion from the feed point and then meeting at the intersection, and then sequentially going along the third portion and the ground plane is equivalent to a wavelength of the first frequency band and 1.5 times a wavelength of the second frequency band.

7. The antenna module as claimed in claim 1, wherein a length of the feed signal going along the first portion and the second portion from the feed point and then meeting at the intersection, and then sequentially going along a part of the first section of the third portion, the coupling gap, the parasitic radiator, the second section of the third portion, and the ground plane is equivalent to a wavelength of the third frequency band.

8. The antenna module as claimed in claim 1, wherein the first frequency band is between 617 MHz and 960 MHz, the second frequency band is between 1428 MHz and 2690 MHz, and the third frequency band is between 3300 MHz and 4990 MHz.

9. An electronic device, comprising:

a heat dissipation conductor;

an insulating housing, covering at least part of the heat dissipation conductor; and an antenna module, arranged on the insulating housing, wherein the insulating housing is located between the main radiator of the antenna module and the heat dissipation conductor, and the ground plane of the antenna module is connected to the heat dissipation conductor, wherein the antenna module comprises:

a feed point;

a ground plane;

a main radiator, comprising a first portion, a second portion, and a third portion, wherein the first portion and the second portion extend from the feed point and meet at an intersection, the third portion at least comprises a first section and a second section, the first section of the third portion is connected to the intersection, and the second section is connected to the ground plane; and a parasitic radiator, connected to the second section and extending towards the first section of the third portion and keeping a coupling gap away from the first section, wherein a feed signal is configured to branches at the feed point and go through the first portion and the second portion and then merge at the intersection, and then sequentially go through the third portion and the ground plane to excite at a first frequency band and a second frequency band, and the feed signal is configured to go along the first portion and the second portion from the feed point and then merge at the intersection, and then sequentially go along a part of the first section of the third portion, the coupling gap, the parasitic radiator, the second section of the third portion, and the ground plane to excite at a third frequency band.

10. The electronic device as claimed in claim 9, wherein the antenna module further comprises an extended radiator extending from the third portion to adjust impedance matching of the first frequency band.

11. The electronic device as claimed in claim 9, wherein a length of the first portion is greater than a length of the second portion, and a maximum width of the first portion is less than a maximum width of the second portion.

12. The electronic device as claimed in claim 9, wherein the ground plane comprises a first ground portion and a second ground portion separated from each other, the first ground portion is close to the second portion, the second ground portion is connected to the third portion, and the first ground portion and the second ground portion are connected to a system ground plane.

13. The electronic device as claimed in claim 9, wherein the coupling gap is located between the parasitic radiator and the first section of the third portion.

14. The electronic device as claimed in claim 9, wherein a length of the feed signal going along the first portion and the second portion from the feed point and then meeting at the intersection, and then sequentially going along the third portion and the ground plane is equivalent to a wavelength of the first frequency band and 1.5 times a wavelength of the second frequency band.

15. The electronic device as claimed in claim 9, wherein a length of the feed signal going along the first portion and the second portion from the feed point and then meeting at the intersection, and then sequentially going along a part of the first section of the third portion, the coupling gap, the parasitic radiator, the second section of the third portion, and the ground plane is equivalent to a wavelength of the third frequency band.

16. The electronic device as claimed in claim 9, wherein the first frequency band is between 617 MHz and 960 MHz, the second frequency band is between 1428 MHz and 2690 MHz, and the third frequency band is between 3300 MHz and 4990 MHz.

17. The electronic device as claimed in claim 9, wherein a distance between the main radiator and the heat dissipation conductor is between 2 mm and 20 mm.

* * * * *